United States Patent [19]

Walz

[11] Patent Number: 4,534,917

[45] Date of Patent: Aug. 13, 1985

[54] METAL POWDERS AND A PROCESS FOR THE PRODUCTION THEREOF

[76] Inventor: Alfred Walz, Am Kurzarm 7, D-7830 Emmendingen, Fed. Rep. of Germany

[21] Appl. No.: 594,829

[22] Filed: Mar. 29, 1984

[30] Foreign Application Priority Data

Mar. 29, 1983 [DE] Fed. Rep. of Germany ..... 3311343

[51] Int. Cl.[3] ..... B05B 7/08

[52] U.S. Cl. ..... 264/12; 425/6; 425/7; 264/13

[58] Field of Search ..... 75/251; 264/12, 13; 425/6, 7; 419/23

[56] References Cited

U.S. PATENT DOCUMENTS

| | | | |
|---|---|---|---|
| 3,549,531 | 12/1970 | Santt | 75/251 |
| 3,719,733 | 3/1973 | Rakestraw et al. | 264/12 |
| 4,233,062 | 11/1980 | Siddall | 264/12 |
| 4,402,885 | 9/1983 | Roehrig et al. | 264/12 |
| 4,469,313 | 9/1984 | Ichidate et al. | 425/7 |

*Primary Examiner*—Wayland Stallard

*Attorney, Agent, or Firm*—Browdy and Neimark

[57] ABSTRACT

Pore-free metal powders, consisting of powder particles having a singly curved smooth surface and a mean diameter of between 5 and 35 microns are made by providing a container having an inflow opening; flowing metal melt and gas, at a temperature ranging from 0.7 to 1.5 times the solidification temperature of the melt in °K, into the container through the inflow opening; maintaining the ratio of gas pressure within the container to gas pressure outside the container at the inflow opening at less than 1:5, thereby creating a supersonic flow of gas from outside the container, through the inflow opening, and into the container; and contacting the flowing metal melt with the supersonic flow of gas at a point near the inflow opening and thereby forming the melt into threads which subsequently and spontaneously collapse to form the powder particles.

9 Claims, 4 Drawing Figures

METAL POWDERS AND A PROCESS FOR THE PRODUCTION THEREOF

Figure 1:
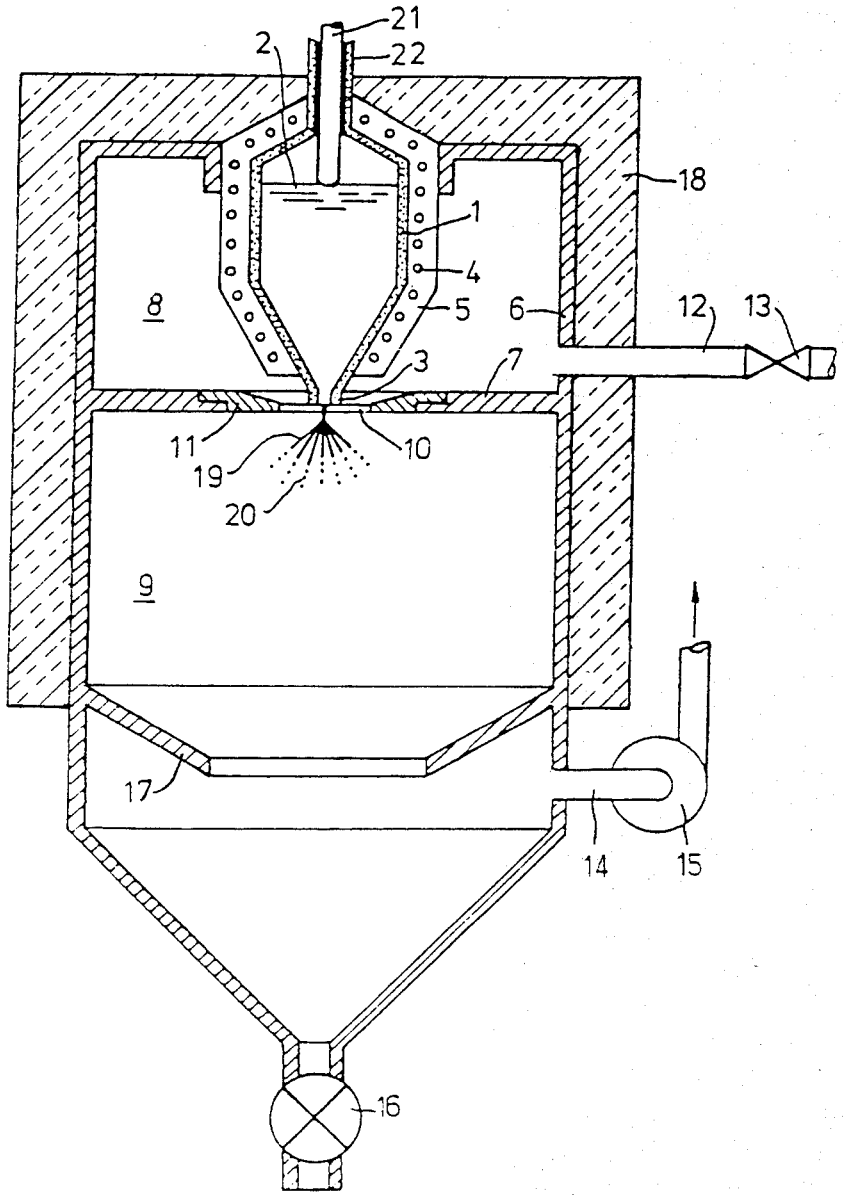

This invention relates to particularly finely-divided metal powders, and to a process for the production thereof. Powders metallurgy has led to the development of materials which ar no longer accessible to conventional processing methods, such as shaping and cutting. Sintered alloys have become particularly important, in which finely-divided metal powders of different metals are mixed and are only alloyed during the sintering procedure. In sinter metallurgy, the shaping is effected by the sintering process.

Sintering metallurgy requires metal powders which are as finely-divided as possible in order on the one hand to be able to achieve surfaces which are as smooth as possible and, on the other hand, to provide as large a surface as possible for the formation of sintered alloys. Furthermore, it is desirable to use spherical powder particles which are as dense as possible in order to obtain sintered bodies which are dense as possible.

It now appears that the considerable surface tension of the metal melts imposes a natural limit, which is about 50 μm powder diameter, on the conventional processes for the production of metal powders, such as pressure pulverisation or flame pulverisation. Once this limit has been reached, it is hardly still possible to further divide melt balls. The surface tension opposes the further division by a resistance which is all the greater the narrower the radius of curvature of the melt surface already is.

A process has now been found which allows the production of metal powders, the powder particles of which are dense and pore-free, and which also have a very good approximate spherical shape and an average diameter of way below 50μ.

Thus, the present application provides pore-free metal powders which are characterised in that the powder particles have singly curved, smooth surfaces and an average diameter of from 5 to 35μ.

Metal powders which are preferred according to the present invention have average powder particles diameters of from 5 to 20μ, preferably from 8 to 15μ. Furthermore, the powder particles preferred according to this invention have diameter distributions having a standard deviation of at most 2.5, more preferably a standard deviation of at most 2.0. The standard deviation is defined by the numerical frequency of the powder diameter in a production charge without sifting out coarse powder particles.

Metal powders which are particularly preferred according to the present invention mainly consist of approximately strictly spherical individual powder particles. 90% of the powder particles forming the metal powder should have a deviation from the spherical shape of less than 10%. The expression "a deviation from the spherical shape by 10%" means that the largest diameter of the powder particles is at most 10% greater than the smallest diameter.

It is essential for the particular suitability of the metal powders according to the present invention for sinter metallurgy that the powder particles have singly curved surfaces. The expression "a singly curved surface" is understood as meaning that each tangent to the surface has only one point of contact with the metal particle.

All metals or metal alloys may be used as metals. Iron, cobalt, nickel, chromium, aluminium or alloys thereof are included in particular. The metal powders may have a crystalline structure or they may be amorphous. In particular, it is also possible to obtain, for example, iron alloys with additions of crystallisation inhibitors, such as chromium or boron, as metal powders according to the present invention. Metal powders of this invention of silver, platinum, iradium or alloys thereof are suitable for use as catalysts.

The present invention also provides a process for the production of metal powders which is characterised in that a flow of metal melt and gas are allowed to flow into an opening of a container, the ratio of gas pressure in the vicinity of the inflow opening outside the container and the gas pressure inside the container is predetermined to be greater than 5, and furthermore the opening of the container is selected so that the ratio of the mass flows of gas and metal melt entering into the container is greater than 8. The temperature of the gas flowing into the container through the opening should range from 0.7 to 1.5 times the solidification temperature of the melt in °K, before flowing in. The ratio of the mass flows of gas and melt should preferably be smaller than 25, more preferably smaller than 15.

The metal melt preferably only comes into contact with the gas flowing into the opening at a point in the container opening in which the gas pressure has dropped to less than 60% of the pressure upstream of the opening, i.e. at a point in which the gas already has almost the velocity of sound. The pressure at the point where melt and gas come into contact should, however, still be at least one fifth, preferably still at least one third, of the gas pressure upstream of the container opening. The gas should preferably have supersonic speed at the first point of contact with the metal melt.

All gases which do not react with the metal melt may be used. Therefore, oxygen should generally be avoided. Extremely pure inert gases, such as helium or argon, are preferably used. Hydrogen may also be used in the case of metals which do not form hydrides. In the case of metals which do not form nitrides, nitrogen may also be used. Waste gases, such as carbon monoxide may also be advantageous under certain conditions. Furthermore, it is possible to achieve particular effects by controlling the composition of the gas. For example, by using a gas which has a low oxygen partial pressure, metal powders having a surface oxide layer may be obtained which may be advantageously used as, for example, catalysts.

It is accepted that the formation of very fine metal powders takes place according to the present process via the intermediate stage of the development of melt threads, the melt threads representing a thermodynamically extremely unstable intermediate condition due to the high ratio of surface tension of viscosity. The melt threads tend to disintegrate into droplets on account of their instability. Therefore, the temperature of the gaseous medium must be selected to be high enough so that the melt threads do not solidify before disintegrating into droplets. The fibrous intermediate stage develops within a very short time. The melt disintegrates violently upon entering into the considerable pressure drop and is drawn out into fibres by the high gas speed. Thus, for the production of very fine powders, it is essential that the formation of sufficiently thin melt fibres takes place before the disintegration into droplets.

The melt therefore preferably emerges from the crucible, i.e. it comes into contact with the gas, at the point where there is the highest pressure gradient of the gas flow, and at the same time the gas flow already has an adequately high speed, but it still has a sufficient density for drawing out the disintegrated melt flow. The density should preferably still amount to at least 0.5 bars.

The pressure upstream of the opening of the container may range from 1 to 30 bars, preferably from 1 to 10 bars. A pressure of 1 bar generally suffices. By using a higher pressure, it is possible to increase the pressure gradient $\Delta p/\Delta 1$ which effects the distintegration of the melt flow, as well as to increase the density of the supersonic flow which causes the disintegrated melt to be drawn out into threads.

Accordingly, if the inflow opening for the gas were to be considered as a nozzle analogously to the jet blasting process for the production of fibres, the nozzle should be designed to be as short as possible in the direction of flow, so that the pressure gradient is as great as possible below the point of the narrowest nozzle cross section.

The melt must not solidify in the fibre intermediate condition for the formation of powders. For metal melts having melting temperatures of up to 600° C., the solidification of fibres may generally be prevented by controlling the temperature of the gas. Metals which have a higher solidification temperature release their heat mainly by radiation.

For the formation of powder particles which are approximately spherical as far as possible, such metals are heated in the crucible preferably to a temperature of a few 100 K. above the solidification temperature.

This invention also provides an apparatus for the production of metal powders, which apparatus consists of two gas chambers which are joined by at least one gas passage opening. The apparatus also has means for the production of a pressure difference between the two gas chambers, and it also has a crucible in the gas chamber having a higher pressure, the crucible having at least one melt outlet opening which is positioned symmetrically to the gas passage opening. The gas passage opening may be designed as a slit-shaped opening, in which case the crucible has a plurality of melt outlet openings positioned in the central plane of the slit-shaped gas passage opening. However, the gas passage openings may also be designed as circular-symmetrical passage openings, one melt outlet opening being provided in the axis of each gas passage opening. The melt outlet openings are preferably designed in the form of melt outlet nipples. The melt outlet nipples preferably discharge into the plane of the narrowest cross section of the gas passage opening.

The length of the gas passage opening in the axial direction should not exceed the diameter of the gas passage opening in the narrowest point. The gas passage opening should preferably widen at an angle of aperture of more than 90°, more preferably more than 120° from the point of the narrowest cross section in the direction of flow.

Furthermore, the melt outlet nipples of the crucible should preferably extend into the gas passage opening by such a distance that the melt outlet openings discharge into the plane in which the gas passage opening begins to widen.

Figure 2:
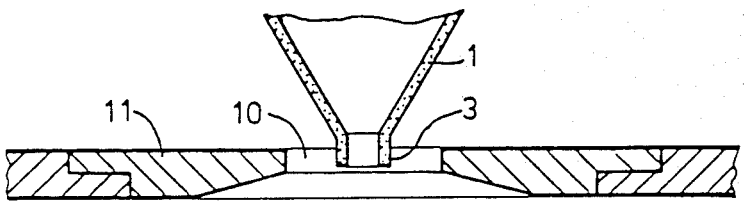
Figure 3:
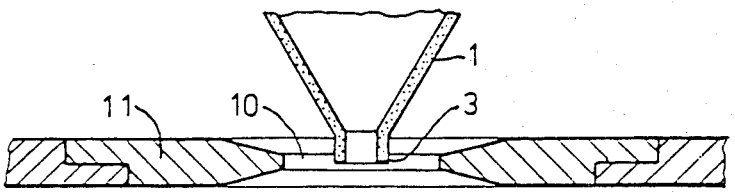
Figure 4:
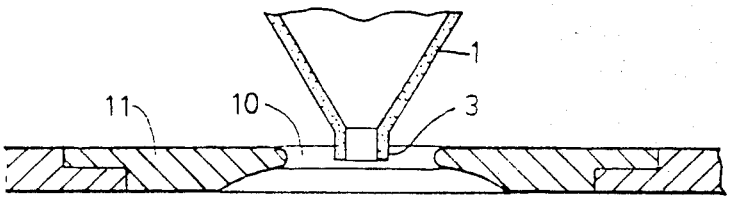

The process and the apparatus according to the present invention will now be described in more detail using the accompanying drawings, wherein:

FIG. 1 shows by way of example an apparatus for carrying out the present process; and FIGS. 2 to 4 show possible embodiments according to the present invention for the gas passage opening.

FIG. 1 shows a metal crucible 1 which contains a metal melt 2. The crucible may be made of, for example, quartz glass, sintered ceramics or graphite. The crucible 1 has at least one melt outlet nipple 3 on its lower side. The melt outlet nipple may have, for example, one opening which is from 0.3 to 1 mm in diameter. Furthermore, the crucible is heated. The crucible may be heated by means of a resistance heating 4 which is embedded, for example in a ceramic mass 5. A man skilled in the art is capable of providing other possibilities for heating the melt, for example a high frequency induction heating, direct electrical heating by means of electrodes which dip into the melt, etc. when a graphite crucible is used, one electrode, for example, may be the crucible. Furthermore, it is possible to provide a heating by flames inside or outside the crucible. The crucible 1 is positioned inside a container 6 which is subdivided into a top gas chamber 8 and a bottom gas chamber 9 by a dividing wall 7. The gas chambers 8 and 9 are connected by a passage opening 10. This passage opening 10 is formed by a moulding 11 fitted into the dividing wall 7. The top gas chamber 8 has a gas supply line 12 with a valve 13 for adjusting the gas pressure in the chamber 8. The bottom gas chamber 9 contains a gas removal line 14 with a conveying pump 15 for adjusting and maintaining the gas pressure in the bottom chamber 9. The base of the bottom gas chamber 9 is of a conical design and has a sluice 16 for sluicing out the metal powder which has formed. Furthermore, a conical intermediate bottom 17 may be provided which is used for collecting and separating the metal powder from the gas. Thermal insulation 18 may be provided, in particular for the top gas chamber.

In order to carry out the present process, the crucible 1 is filled with the melt to be separated into fibres. Thereafter, the gaseous medium is introduced by means of the valve 13. Once the metal starts to melt in the crucible, the bottom gas chamber 9 is evacuated to a pressure of, for example, from 10 to 100 torr by means of the pump 15, and at the same time sufficient gas is subsequently supplied through the valve 13 for a pressure of, for example, 1 bar to be maintained in the top gas chamber. The gas which is supplied may be, for example, at the temperature of the melt 2. Once the metal has melted in the crucible 1, a flow of melt issues from the nipple 3 which is divided under the effect of the pressure gradient forming in the gas passage opening, and is first of all drawn out into fibres 19 under the effect of the gas flowing at supersonic speed, the fibres 19 then disintegrating into droplets 20. Cooling takes place due to the adiabatic cooling of the gaseous medium while passing through the opening 10. If an inert gas is used as the gaseous medium, it may be returned into the top gas chamber 8 via the gas supply line 12 by means of the pump 15 and a connection line which is not shown. The metal powder which forms is periodically sluiced out through the sluice 16 while maintaining the gas pressure in the gas chamber 9. Metal may be supplied into the crucible 1, for example by subsequently pushing a metal bar 21 through the upper crucible opening 22, and the bar melts down when it comes into contact with the melt 2. The moulding 11 which forms the gas passage opening 10 is preferably made of heatresistant material, for example ceramic material or quartz glass.

FIGS. 2 to 4 show alternative embodiments for the formation of the gas passage opening 10. The reference numerals used in these Figs. denote the same elements in each case as in FIG. 1.

EXAMPLE

A metal melt of soldering tin having a melting point of 300° C. is produced in an apparatus according to FIG. 1. Air is used as the gaseous medium. A pressure of 1bar prevails in the top gas chamber 8. A pressure of 0.01 bar is maintained in the bottom gas chamber 9. The nipple 3 of the quartz crucible 1 positioned in the concentric gas passage opening 10 having a diameter of 3 mm has an open cross section of 0.5 mm in diameter and a wall thickness of 0.2 mm. The helium gas supplied via the line 12 is at the temperature of the metal melt of 300° C. 19 g of metal powder are obtained per second from one melt outlfow opening 3. The powder consists of spheres having diameters of from 5 to 50$\mu$. The mean of the diameter distribution is at 10$\mu$. Only very few powder particles have diameters of about 30$\mu$. Deviations from the spherical shape are found in isolated cases. These powder particles have an elliptical shape. The individual powder particles have a smooth surface, on which individual crystallities may be seen as differently reflecting regions, without the spherical shape being disturbed.

I claim:

1. A process for the production of pore-free metal powders, said powders consisting of powder particles having a singly curved smooth surface and a mean diameter of between 5 and 35 microns; said process comprising the steps of:

providing a container, said container having an inflow opening;

flowing metal melt and gas into said container through said inflow opening;

maintaining the ratio of gas pressure within said container to gas pressure outside said container at said inflow opening at less than 1:5, thereby creating a supersonic flow of gas from outside said container, through said inflow opening, and into said container;

contacting said flowing metal melt with said supersonic flow of gas at a point near said inflow opening;

whereby said metal melt, after contacting said supersonic flow of gas, forms into threads which subsequently and spontaneously collapse to form said powder particles.

2. A process according to claim 1, wherein the gas flowing into the container has, outside said container, at said inflow opening, a temperature ranging from 0.7 to 1.5 times the solidification temperature of the melt in °K.

3. A process according to claim 1, wherein the metal melt is brought into contact with said supersonic flow of gas at a point in the container inflow opening where the gas pressure has fallen to less than 60% of the pressure upstream of the inflow opening.

4. A process according to claim 2, wherein the metal melt is brought into contact with said supersonic flow of gas at a point in the container inflow opening where the gas pressure still amounts to at least a fifth of the pressure upstream of the container opening.

5. An apparatus for the production of pore-free metal powders consisting of powder particles having a singly curved smooth surface and a mean diameter of between 5 to 35$\mu$, prefrably 8 to 15$\mu$, said apparatus comprising two gas chambers connected to each other by at least one gas passage opening, means for the production of a pressure difference between the two gas chambers of a magnitude sufficient to cause supersonic flow of a gas through said gas passage opening, a crucible having at least one melt outlet opening positioned in the gas chamber which has a higher pressure, the melt outlet opening being positioned symmetrically, coaxially or concentric, to the gas passage opening.

6. An apparatus according to claim 5, wherein the gas passage opening widens at an angle of at least 90°, preferably 120° from the point of the narrowest cross section onwards, in the direction of said flow.

7. An apparatus according to claim 5, wherein the melt outlet opening discharges in the plane of the narrowest point of the gas passage opening.

8. The process of claim 1, wherein said melt comprises an alloy, and further comprising the formation of a sintered alloy, by further steps comprising sintering said powder particles.

9. The process of claim 1 further comprising the step of forming said powder particles into a mold body by further steps comprising sintering said powder particles within a mold.

* * * * *